US006381810B2

(12) United States Patent
Hsieh

(10) Patent No.: US 6,381,810 B2
(45) Date of Patent: May 7, 2002

(54) BELT LOCK

(75) Inventor: Yun-Mei Hsieh, Chung-Li (TW)

(73) Assignee: Taiwan Industrial Fastener Corp., Taipei (TW)

( * ) Notice: Subject to any disclaimer, the term of this patent is extended or adjusted under 35 U.S.C. 154(b) by 0 days.

(21) Appl. No.: 09/741,061

(22) Filed: Dec. 21, 2000

(30) Foreign Application Priority Data

Mar. 15, 2000 (TW) ..... 89204129 U

(51) Int. Cl.[7] ..... A44B 11/12
(52) U.S. Cl. ..... 24/170; 24/191; 24/196
(58) Field of Search ..... 24/170, 191, 195, 24/196

(56) References Cited

U.S. PATENT DOCUMENTS 3,608,158 A * 9/1971 Bengtsson ..... 24/170
4,843,688 A * 7/1989 Ikeda ..... 24/170
5,661,877 A * 9/1997 Bloomer ..... 24/170
5,920,963 A * 7/1999 Chou ..... 24/170

FOREIGN PATENT DOCUMENTS

GB 1169020 * 10/1969 ..... 24/170

* cited by examiner

*Primary Examiner*—Victor Sakran
(74) *Attorney, Agent, or Firm*—Bacon & Thomas, PLLC

(57) ABSTRACT

A belt lock includes a casing, the casing having a serrated engagement portion and a bearing portion respectively disposed at a bottom wall thereof at a top side, and two parallel upright side walls at two sides of the bottom wall, and a locking unit pivoted to the upright side walls of the casing and adapted to lock a belt being inserted through the casing, the locking unit including a handle pivoted to the casing and turned between a locking position and an unlocking position, and a sector-like swivel pressure block pivoted to the handle, the handle having two barrels bilaterally disposed at a front side thereof and respectively pivoted to the pivot holes of the upright side walls of the casing, the swivel pressure block having a serrated engagement portion adapted for pressing on the inserted belt against the bearing portion of the casing when the handle is turned to said locking position.

10 Claims, 4 Drawing Sheets

BELT LOCK

BACKGROUND OF THE INVENTION

The present invention relates to a belt lock and, more specifically, to such a belt lock, which fits belts of different thickness.

A variety of belt locks have been disclosed for use in shoes, safety belts, binding devices, and etc. FIG. 5 shows a belt lock for this purpose. This structure of belt lock comprises a base member B, and a locking member A. The base member B comprises a shaft B1, and an engagement portion B2 disposed in parallel to the shaft B1. The locking member A comprises a coupling hole A1 pivoted to the shaft B1 of the base member B, and an engagement portion A2 adapted for working with the engagement portion B2 of the base member B to hold down the inserted belt member. This structure of belt lock is suitable for locking a belt member of a particular thickness. For locking a different thickness of belt member, a different specification of the base member B and the locking member A must be used.

SUMMARY OF THE INVENTION

The present invention has been accomplished to provide a belt lock, which eliminates the aforesaid problem. It is the main object of the present invention to provide a belt lock, which fits belt members of different thickness. According to the present invention, the belt lock comprises a casing, and a locking unit 2 pivoted to the casing and adapted to lock the belt member being inserted through the casing. The locking unit comprises a handle pivoted to the casing, and a swivel pressure block pivoted to the handle and driven by the handle to hold down the inserted belt member. The swivel pressure block has a serrated engagement portion extended along a smoothly arched peripheral wall thereof for engaging any of a variety of belt members of different thickness.

DETAILED DESCRIPTION OF THE PREFERRED EMBODIMENT

Figure 1:
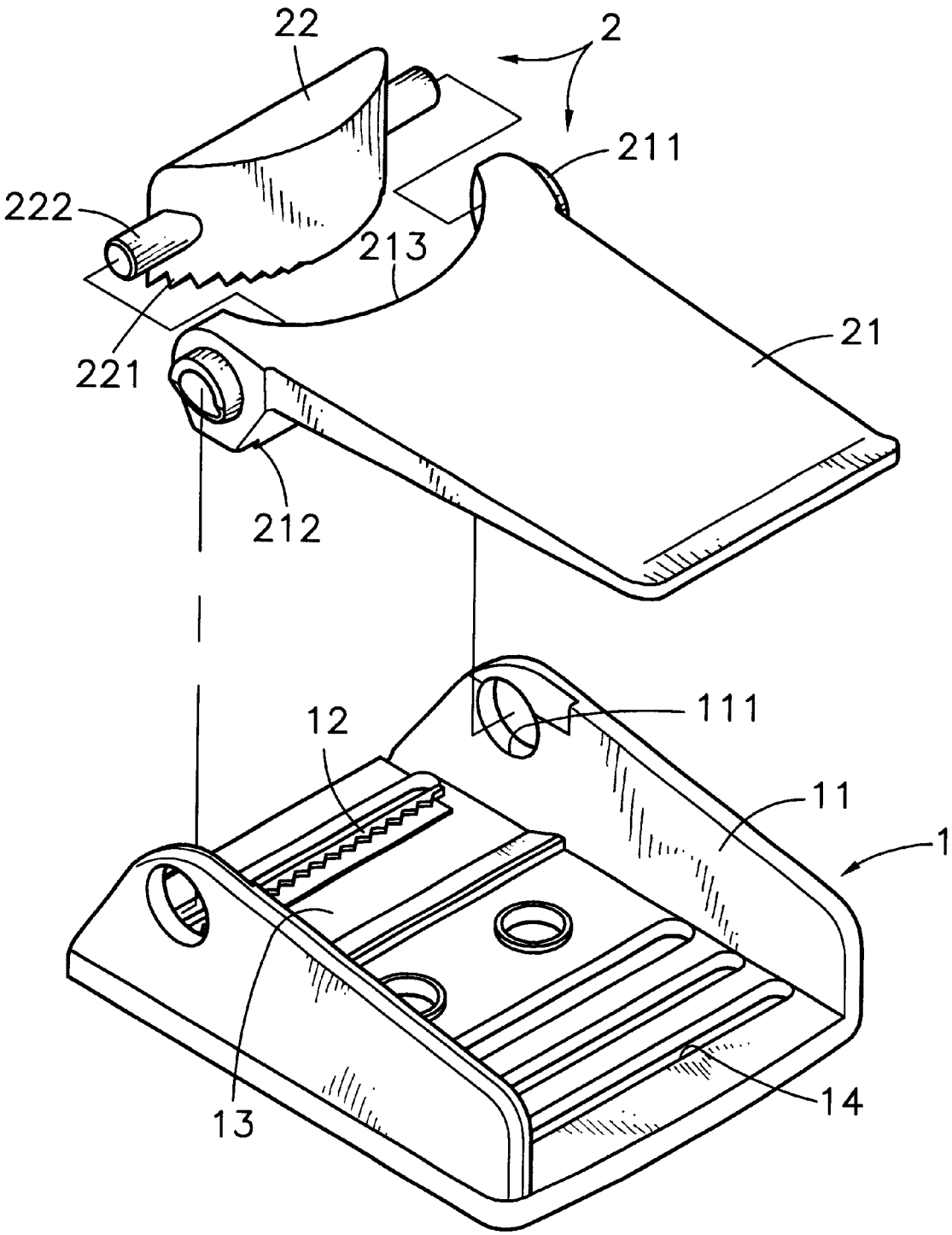
FIG. 1 is an exploded view of a belt lock according to the present invention.
Figure 2:
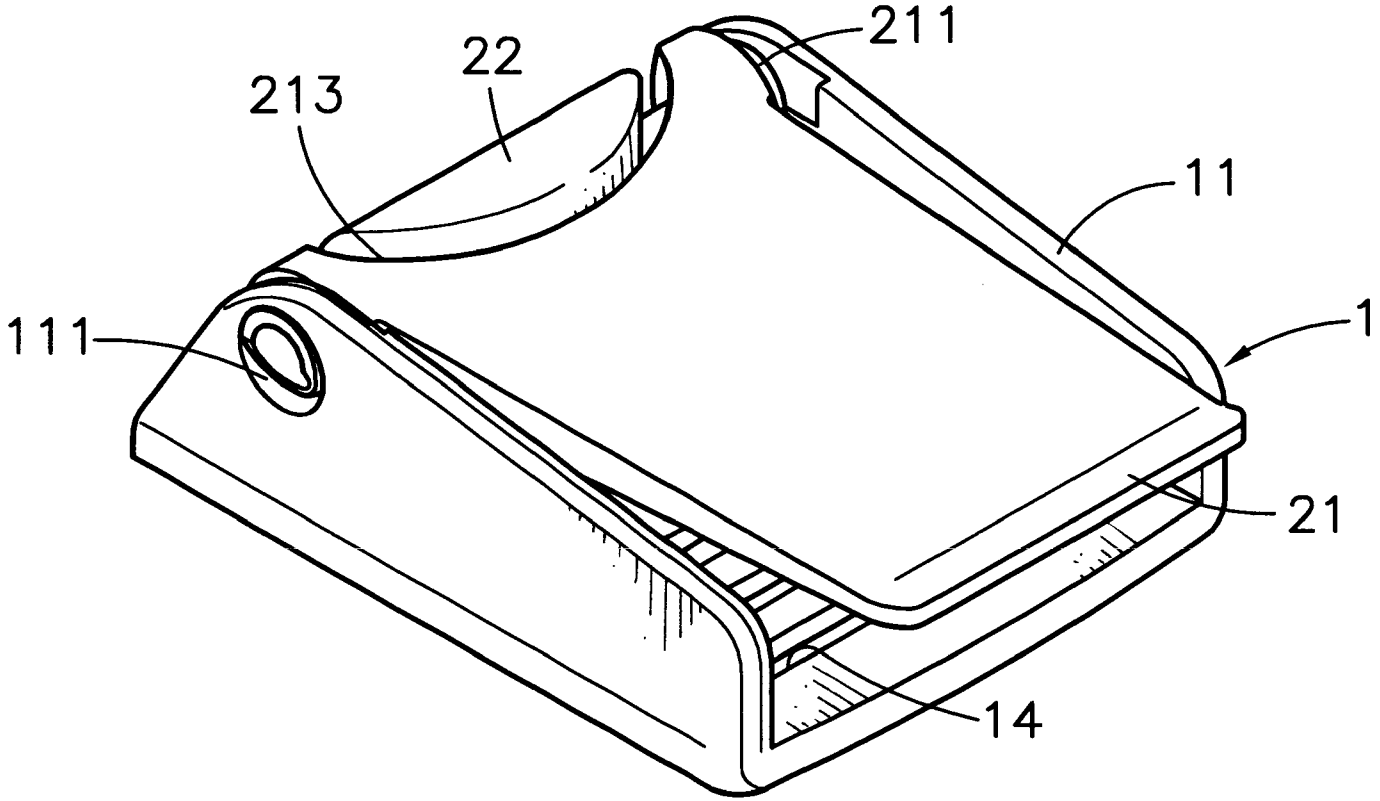
FIG. 2 is an elevational assembly view of the belt lock according to the present invention.

Referring to FIGS. 1 and 2, a belt lock in accordance with the present invention is comprised of a casing 1, and a locking unit 2. The casing 1 comprises a plurality of transverse belt slots 14 arranged in parallel near the rear side thereof, a serrated engagement portion 12 transversely disposed near the front side thereof, a bearing portion 13 transversely disposed adjacent to the serrated engagement portion 12, two parallel side walls 11 respectively perpendicularly extended from two opposite lateral sides thereof, and two pivot holes 111 respectively provided at the parallel side walls 11 near the front side. The locking unit comprises a handle 21, and a swivel pressure block 22. The handle 21 comprises a smoothly arched inwardly curved front notch 213, and two barrels 211 aligned at two sides of the front notch 213. The barrels 211 each have a serrated engagement portion 212 disposed at a bottom side. The swivel pressure block 22 is a sector-like block comprising two pivot rods 222 aligned at two sides, and a serrated engagement portion 221 disposed at the bottom side wall thereof along the smoothly arched periphery. The barrels 211 of the handle 21 are respectively coupled to the pivot holes 111 of the casing 1. The pivot rods 222 of the swivel pressure block 22 are respectively pivoted to the barrels 211 of the handle 21.

Figure 3:
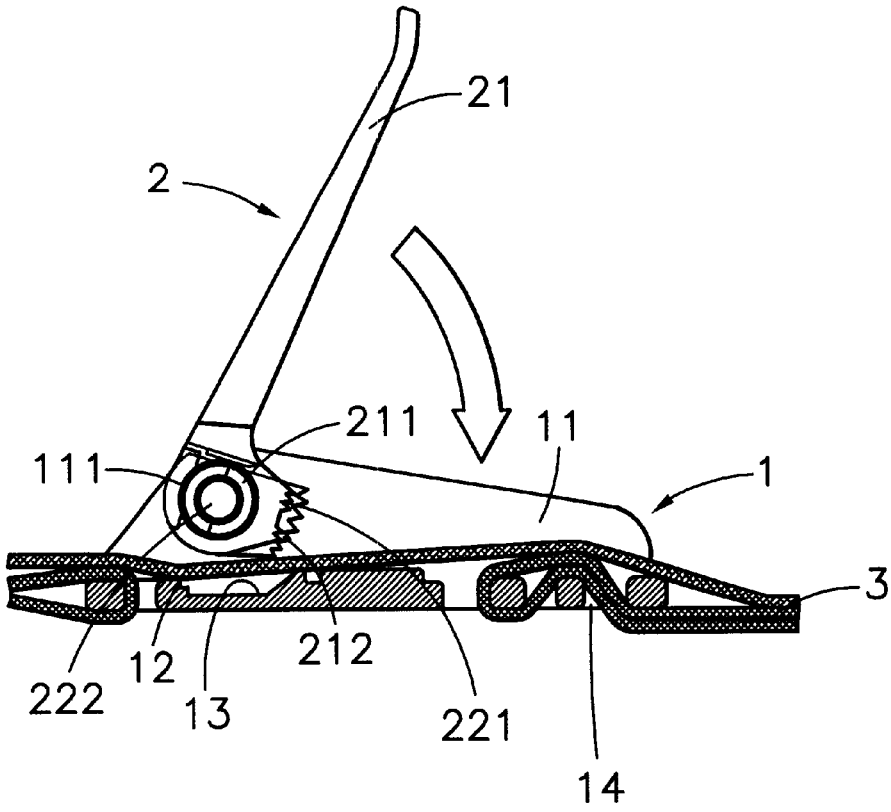
FIG. 3 is a schematic drawing showing the use of the present invention.
Figure 4:
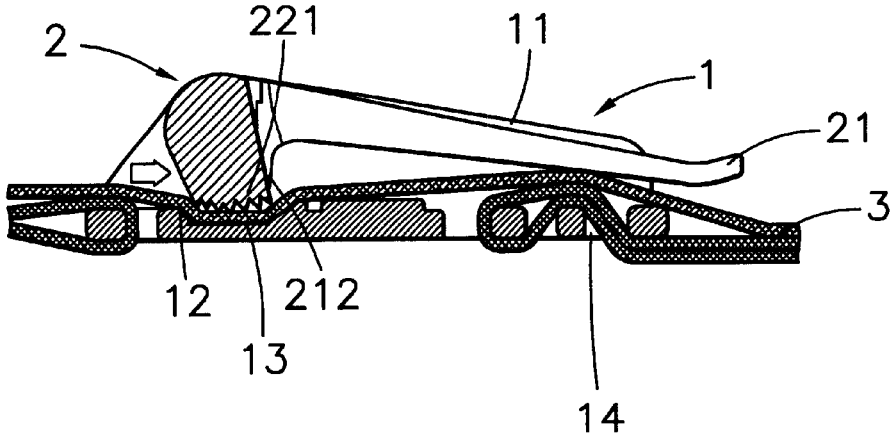
FIG. 4 is a sectional view showing the locking unit turned to the locking position.
Figure 5:
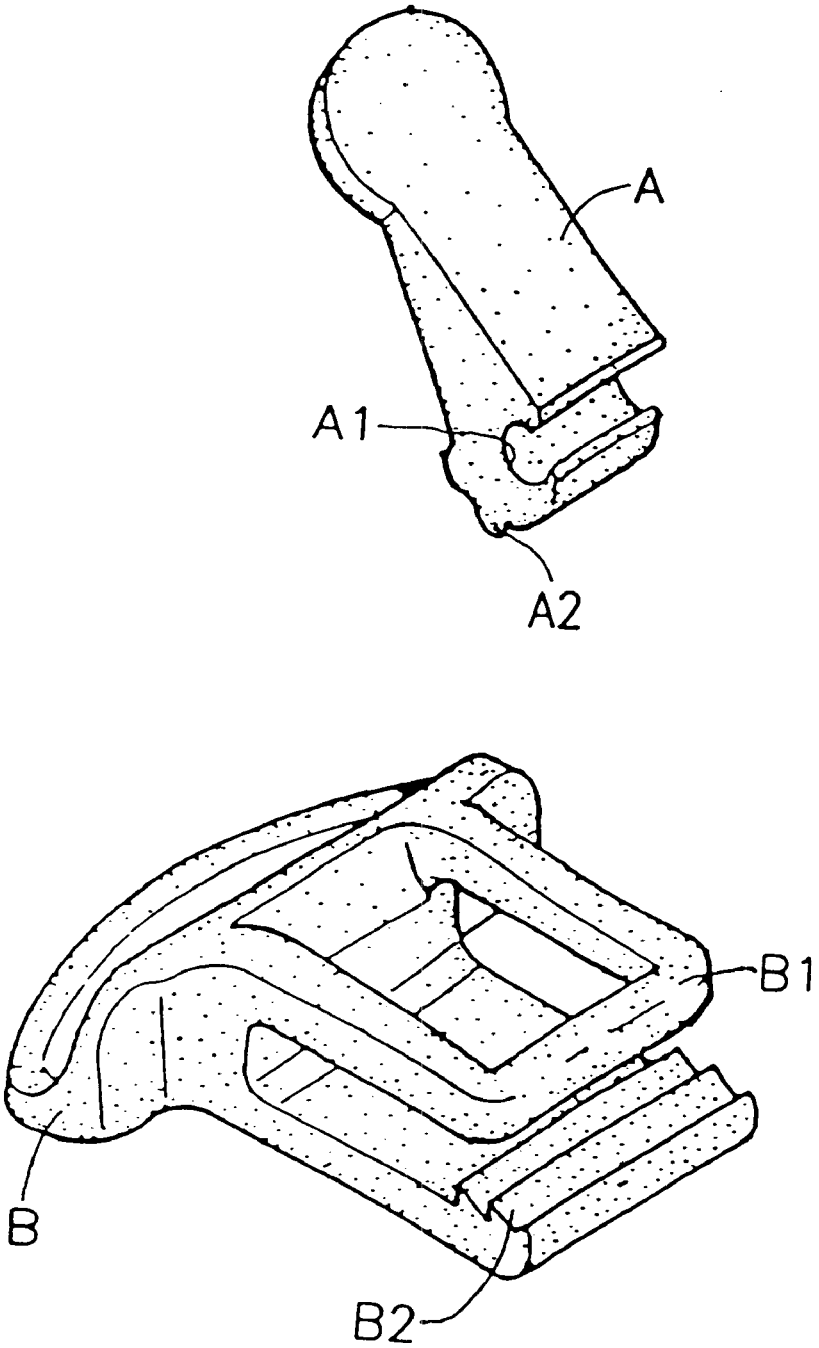
PRIOR ART FIG.5
FIG. 5 is an exploded view of a belt lock according to the prior art.

Referring to FIGS. 3 and 4, a belt 3 is fastened with its one end to the belt slots 14 and inserted with its other end through the gap between the casing 1 and the locking unit 2. When the user turns the handle 21 downwards from the vertical position toward the casing 1, the periphery of the front notch 213 is moved to the smoothly arched periphery of the swivel pressure block 22. Continuously turning the handle 21 downwards causes the swivel pressure block 22 to be rotated clockwise, thereby causing the serrated engagement portion 221 of the swivel pressure block 22 to be pressed on the belt 3 against the bearing portion 13 of the casing 1 and a part of the swivel pressure block 22 pressed on the belt 3 against the serrated engagement portion 12 of the casing 1, and therefore the belt 3 is locked.

Because the serrated engagement portion 221 extends along the smoothly arched periphery of the swivel pressure block 22, it fits different thickness of the belt 3. Further, because the pivot rods 222 can be rotated with the swivel pressure block 22 in the barrels 211 of the handle 21, the angle of engagement of the swivel pressure block 22 with the belt 3 can be adjusted subject to the thickness of the belt 3.

While only one embodiment of the present invention has been described, it will be understood that various modifications and changes could be made thereunto without departing from the spirit and scope of the invention disclosed.

What the invention claimed is:

1. A belt lock comprising:

a casing, said casing comprising a serrated engagement portion and a bearing portion respectively disposed at a bottom wall thereof at a top side, and two parallel upright side walls at two sides of said bottom wall, said upright side walls each having a pivot hole near a front side thereof; and a locking unit pivoted to said casing and adapted to lock a belt being inserted through said casing, said locking unit comprising a handle pivoted to said casing and turned between a locking position and an unlocking position, and a sector-like swivel pressure block pivoted to said handle and driven by said handle to engage the belt being inserted through said casing, said handle comprising two barrels bilaterally disposed at a front side thereof and respectively pivoted to the pivot holes of the upright side walls of said casing, said swivel pressure block comprising a serrated engagement portion adapted for pressing on the inserted belt against the bearing portion of said casing when said handle is turned to said locking position.

2. The belt lock of claim 1, wherein said swivel pressure block comprises two pivot rods aligned at two sides and respectively coupled to the barrels of said handle.

3. The belt lock of claim 1, wherein the serrated engagement portion of said swivel pressure block extends along a smoothly arched periphery thereof.

4. The belt lock of claim 1, wherein said casing further comprises a plurality of transverse belt slots disposed in the bottom wall near a rear side thereof remote from the serrated engagement portion and bearing portion of said casing.

5. The belt lock of claim 1, wherein the serrated engagement portion of said casing extends transversely between said upright side walls.

6. The belt lock of claim 1, wherein said serrated engagement portion is formed of a series of toothed portions of conical cross section.

7. The belt lock of claim 1, wherein the barrels of said handle each have a beveled guide edge for guiding the respective barrel into the pivot hole on the respective upright side wall of said casing.

8. The belt lock of claim 1, wherein said handle comprises a front notch smoothed arched and curved inwards between said barrels corresponding to a smoothly arched peripheral wall of said swivel pressure block.

9. The belt lock of claim 1, wherein said barrels of said handle each have a serrated engagement portion disposed at a bottom side and adapted for pressing the inserted belt on the bearing portion of said casing.

10. The belt lock of claim 1, wherein the bearing portion of said casing is a recessed bearing face.

* * * * *